United States Patent [19]

O'Sullivan et al.

[11] 4,180,019

[45] Dec. 25, 1979

[54] PROCESS HEATER

[75] Inventors: Thomas F. O'Sullivan, Montclair, N.J.; William H. Pollock, East Granby, Conn.

[73] Assignee: The Lummus Company, Bloomfield, N.J.

[21] Appl. No.: 882,544

[22] Filed: Mar. 1, 1978

[51] Int. Cl.[2] ..... F22B 21/24

[52] U.S. Cl. ..... 122/235 N; 122/355

[58] Field of Search ..... 122/235 R, 235 K, 235 N, 122/355, 356

[56] References Cited

U.S. PATENT DOCUMENTS

| | | | |
|---|---|---|---|
| 2,214,711 | 9/1940 | Watts | 122/356 |
| 2,583,599 | 1/1952 | Schoessow | 122/235 |
| 3,254,635 | 6/1966 | Schoppe | 122/356 |
| 4,031,861 | 6/1977 | Pollock | 122/235 |

*Primary Examiner*—Kenneth W. Sprague

*Attorney, Agent, or Firm*—Louis E. Marn; Elliot M. Olstein

[57] ABSTRACT

A process heater which is fired by an ash containing fuel, generally coal, has a housing which includes a front radiant section and a rear convection section. The radiant section is provided with vertically extending process tubes against the walls thereof, arranged in a single row, and horizontal process tubes arranged in a single row across the roof. The horizontal and vertical tubes contain longitudinal fins over the length thereof, with adjacent fins being in contact with each other to provide a fin tube wall which prevents a build-up of ash behind the tubes. The bottom of the radiant section is downwardly and inwardly sloped and terminates in an ash collecting hopper. The process tubes extend along the downwardly and inwardly sloped portion to provide cooling which prevents ash melting whereby ash enters the hopper in solid form for removal. The vertical and horizontal process tubes are interconnected to provide for at least two passes of process fluid through the radiant section.

12 Claims, 7 Drawing Figures

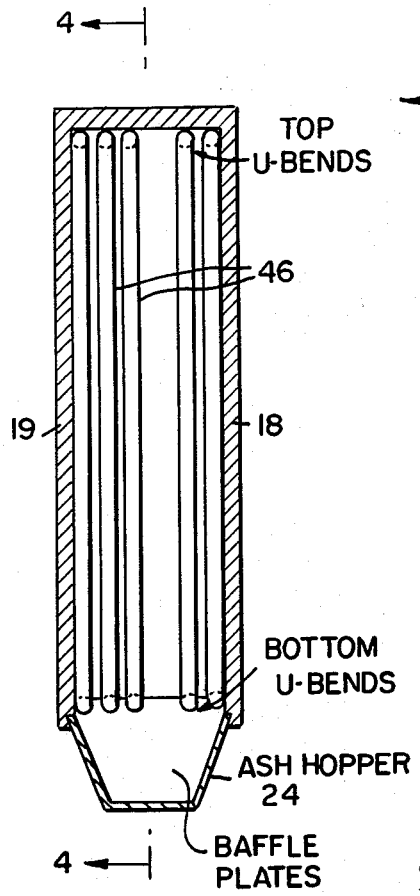
FIG. 3
FIG. 4
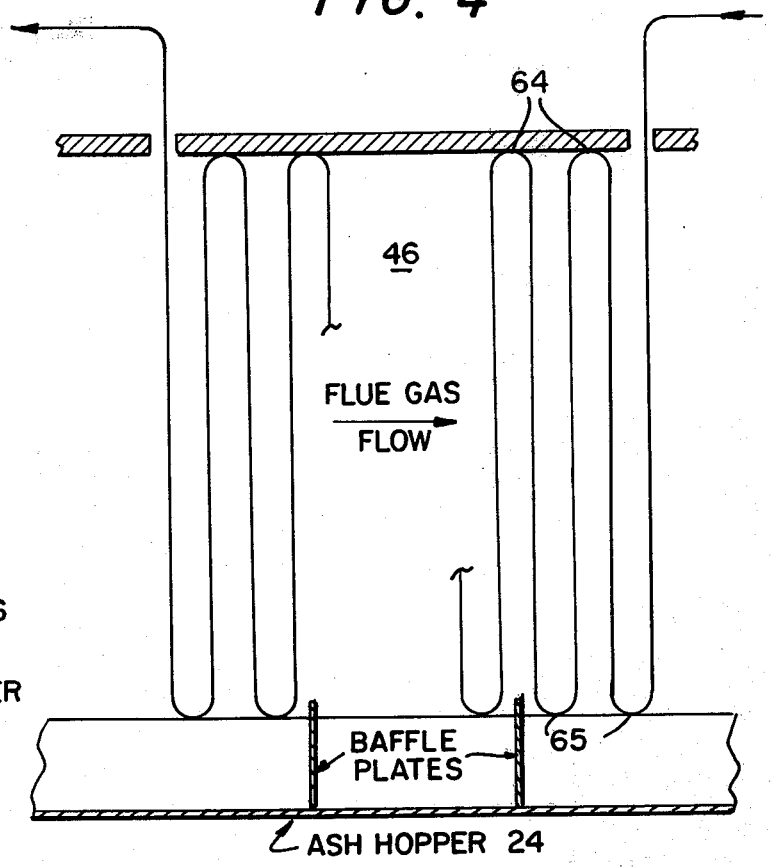
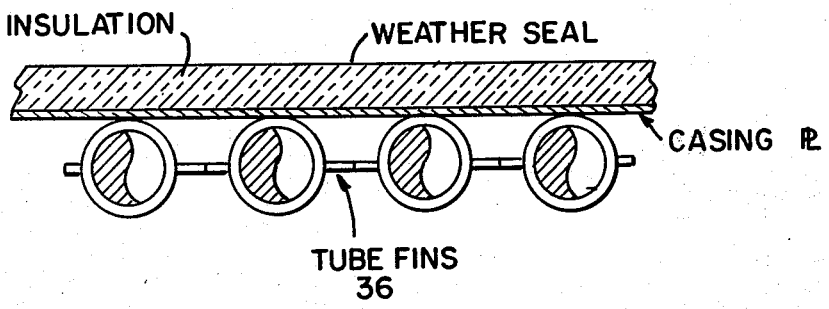
FIG. 5

PROCESS HEATER

This invention relates to process heaters, and more particularly to a new and improved process heater employing an ash containing fuel.

Heating devices which are fired by ash containing fuels, such as boilers and metal working furnaces, are known in the art. In general, however, process heaters for processing various fluids; in particular, hydrocarbon fluids, have certain design requirements which have prevented the use of such ash containing fuel burners for effecting firing thereof. The present invention is directed to a new and improved process heater which can be fired by an ash containing fuel.

In accordance with the present invention, there is provided a process heater which includes a front process or radiant section, and a rear convection section. The front wall of the heater includes at least one burner which is fired by an ash containing fuel; e.g., coal, and the heater is provided with a fluid cooled bottom for effecting ash removal. Vertically extending process tubes are positioned against the vertically disposed walls of the radiant section of the heater in a single row parallel to such walls. The vertical tubes are provided with longitudinal fins, with fins of adjacent tubes being in contact with each other to provide a fin tube wall construction which prevents build-up of ash behind the tubes and eliminates the problem of flowing slag developing on uncooled surfaces. Horizontally extending tubes are positioned against the roof of the radiant section, and extend in a single row between the side walls of the radiant section. The horizontal tubes are also provided with longitudinal fins, with fins of adjacent tubes being in contact with each other to provide a fin tube wall construction over the roof which prevents build-up of ash behind the tubes and eliminates the problem of flowing slag developing on uncooled surfaces. Horizontal and vertical tubes in the radiant section are interconnected (for example, by bent tubes to form a continuous tube, roll joint fittings, welded fittings, etc.) to form at least one process fluid coil in the radiant section having at least two fluid passes therethrough.

The invention will be further described with respect to the following drawings wherein:

FIG. 3 is a sectional view taken along line 3—3 of FIG. 2;

FIG. 4 is a simplified sectional view taken along line 4—4 of FIG. 3;

FIG. 5 is a sectional view taken along line 5—5 of FIG. 1;

Figure 1:
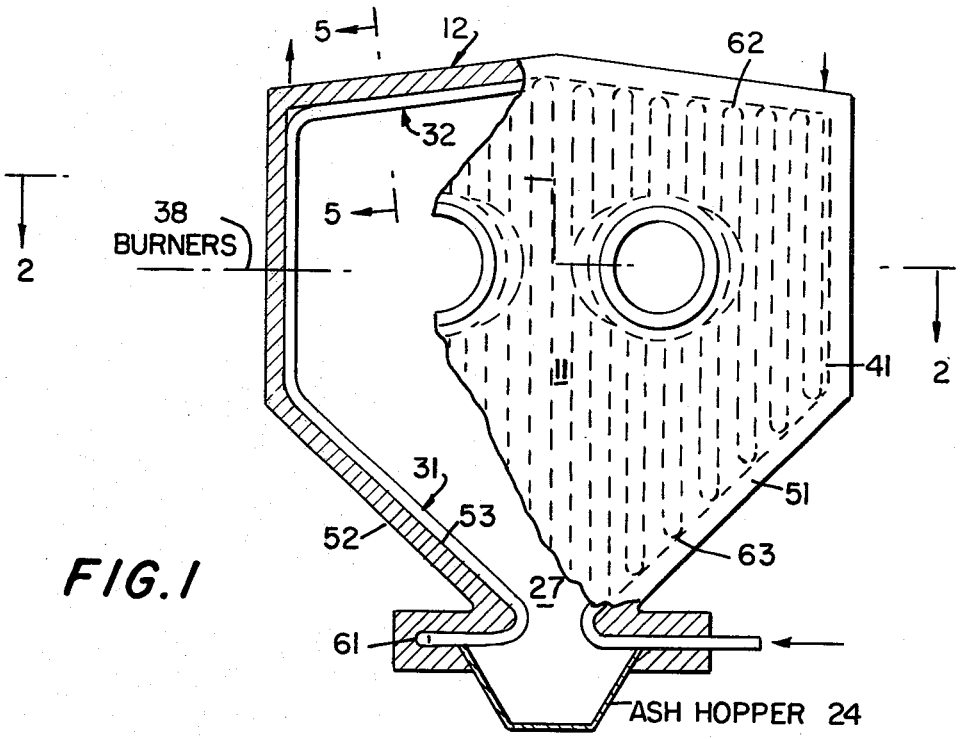
FIG. 1 is a front elevation, partially broken away, of an embodiment of the heater of the present invention.
Figure 2:
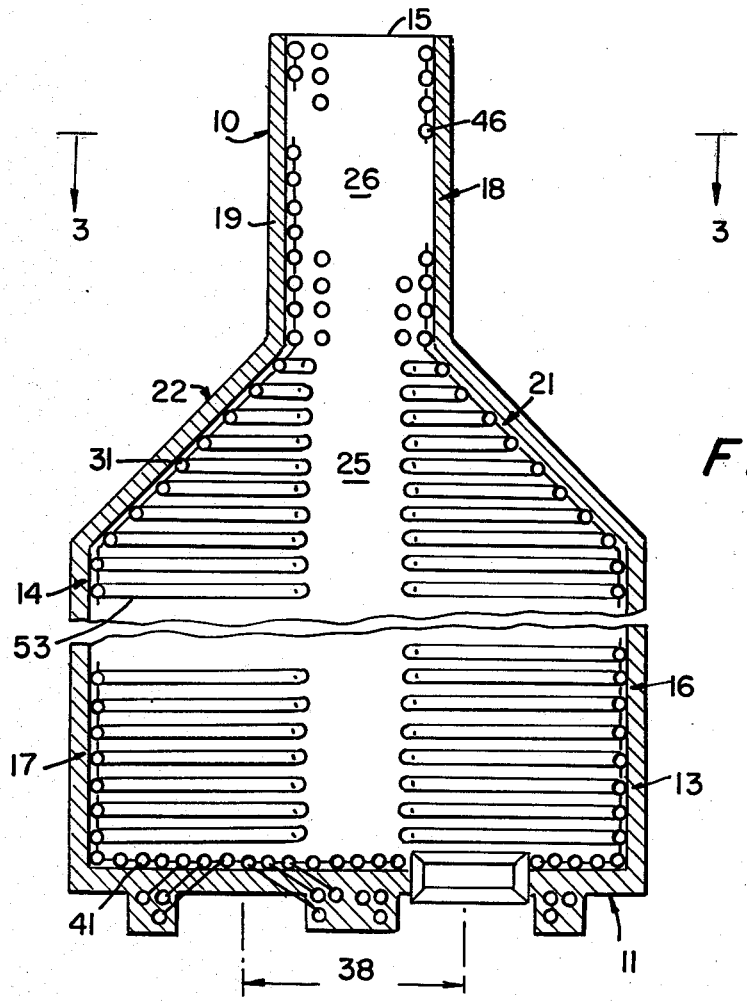
FIG. 2 is a sectional view taken along line 2—2 of FIG. 1.

Referring now to the drawings, there is shown a process heater defined by housing 10 having a front wall 11, roof 12, opposed side walls 13 and 14 and opening 15 opposite front wall 11 for exhausting combustion gases. The opposed side walls 13 and 14 include a first elongated section 16 and 17 adjacent to the front wall, second elongated sections 18 and 19 adjacent opening 15, and inwardly converging sections 21 and 22 between the elongated sections. The front wall 11 includes burners 38 designed to burn an ash containing fuel, with such burners preferably being of the type to burn a solid fuel; in particular, coal.

The front portion of the housing defined by front wall 11, sections 13 and 17 and sections 21 and 22 form a processing or radiant section 25, and the rear portion of the housing defined by sections 18 and 19, form a convection or heat recovery section 26. The use of converging sections 21 and 22 functions to increase the velocity through the convection section 26; however, although such a design is preferred, it is not necessary to provide a throat or restricted transition between the radiant and convection sections.

In radiant section 25, the bottom portions 51 and 52 of side walls 13 and 14 are downwardly and inwardly inclined to form an elongated throat section 27 which communicates with an ash receiving hopper 24, and as hereinafter described, portions 51 and 52 along with the processing tubes form a "coutant"bottom for ash removal.

A single row of closely spaced vertically extending process tubes 31 is postioned against each of the wall portions 16, 17, 21 and 22 of radiant section 25 in a plane substantially parallel to such wall portions, and a single row of closely spaced vertically extending process tubes 41 is positioned against front wall 11 in a plane substantially parallel thereto. A single row of closely spaced horizontally extending process tubes 32 is positioned against the roof 12 of radiant section 25 and the tubes extend between the side walls 13 and 14 in a plane substantially parallel to the roof 12.

The heater is designed such that the process tubes 31 along the side walls are a sufficient distance from the burners 38 to prevent too high a tube skin temperature which could adversely affect the process fluid; i.e., maximum heat flux is controlled by controlling the distance between the burners and tubes.

The convection section 26 includes a plurality of vertically extending convection tubes 46, which are arranged in a plurality of rows substantially parallel to the side walls 18 and 19. In accordance with a preferred embodiment, as shown, one row of tubes 46 is positioned against each of the wall portions 18 and 19 of convection section 26, although such positioning is not necessary.

The vertical tubes 31 and 41 and the horizontal tubes 32 in the radiant section are each provided with a pair of diametrically opposed longitudinal fins 36 which extend over the length of the tubes. As particularly shown, the fins 36 are positioned parallel to the respective wall or roof portion along the center line of the tube; however, other arrangements are possible. Adjacent fins 36 are in contact with each other and form a fin tube wall construction along the walls of the radiant section and roof of the radiant section to prevent a build-up of ash behind the tubes. The fins 26 of adjacent tubes, although in contact with each other, are not joined together to permit longitudinal expansion of the tubes and thereby accommodate differential expansion of adjacent tubes due to the temperature profile of fluid being heated.

The vertical process tubes 31 in radiant section 25 include a bottom downwardly and inwardly inclined bent portion 53 to conform to the configuration of wall sections 51 and 52. The lower portions 53 of the tubes 31 provide a "coutant"bottom for ash removal; i.e., a sloping wall cooled by process fluid in the tubes to prevent the ash from melting whereby the ash enters ash hopper 24 in solid form for removal from the heater.

The tubes 46 along the walls of the convection section also preferably include a fin tube construction, although such a construction is not necessary in that the temperature of the gas entering the convection section is generally below the ash melting point, whereby it is not necessary to prevent contact between ash and refractory walls, as in the radiant section.

The process tubes 31, 32 and 41 in radiant section 26 are interconnected to form one or more processing coils to provide two or more passes of process fluid through each coil.

Figure 6:
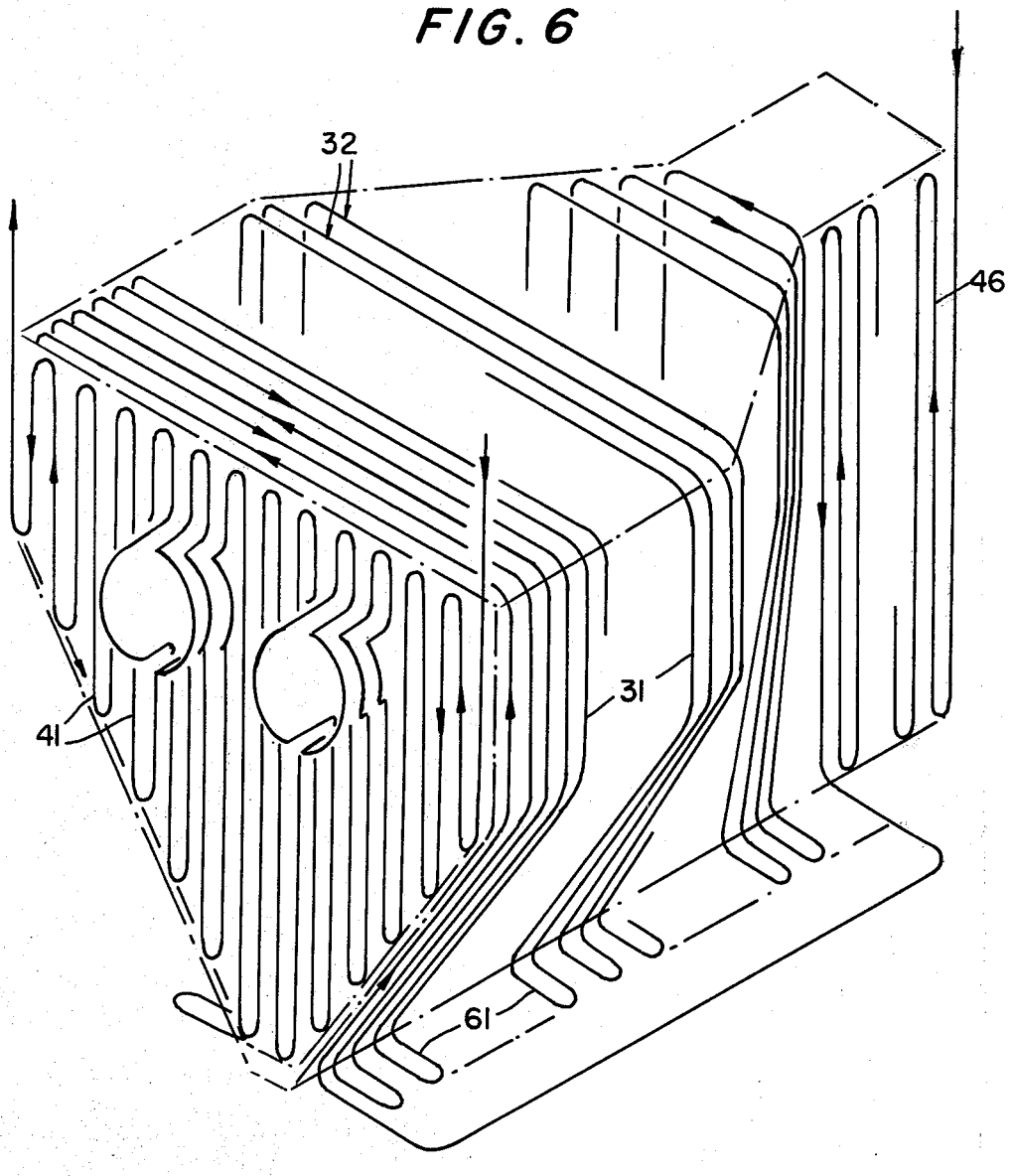
FIG. 6 is a simplified schematic isometric view of a coil arrangement for the heater.

As particularly shown in FIG. 6, the top of a vertical process tube 31 along one side wall 13 is connected to the top of a vertical process tube 31 along side wall 14 by a horizontal tube 32. Vertical process tubes 31 along the side walls are interconnected in pairs through bottom U-bends 61 to provide for fluid flow down and up a side wall prior to passage of fluid to the opposite side wall through a horizontal tube 32. As particularly shown, the bottom U-bends 61 are horizontally positioned in the furnace wall; however, other construction and positioning of the U-bends are possible.

The process tubes 41 along the front wall 11 are interconnected for up and down flow along the front wall 11 through top and bottom U-bends 62 and 63. The tubes 41 include appropriate bent portions for movement around the burners 38.

The convection tubes 46 are also interconnected to provide for up and down fluid flow through the tubes and countercurrent flow to the flow of combustion gases is shown; however, co-current flow can also be used. As particularly shown, each row of vertical tubes 46 parallel to the wall portions 18 and 19 is interconnected through suitable top and bottom U-bends 64 and 65 and is provided with a fluid inlet adjacent opening 15 and an outlet for fluid adjacent to radiant section 25, whereby fluid flows through the convection tubes 46 countercurrent to the flow of gases through convection section 26. The convection tubes 46 may be employed to pre-heat fluid to be introduced into the radiant section or to heat other fluids.

In accordance with the illustrated embodiment of FIG. 6, process fluid is introduced into a row of convection tubes 46 at the outlet of convection section 26 and is withdrawn therefrom adjacent to radiant section 25 whereby the process fluid is pre-heated by the combustion gases. The fluid flows from the convection tubes 46 into the process tubes 31 adjacent front wall 11, for passage through a process coil formed by the vertical tubes 31 and horizontal tubes 32 by sequential flow down and up one side wall and through the horizontal tubes for passage down and up the opposite wall prior to being withdrawn from the heater. Although only a single coil is shown, it is to be understood that the tubes 31 and 32 may be formed into more than one coil.

Process fluid is also introduced into the process tubes 41 along front wall 11 for passage through the radiant section 25 in up and down flow along front wall 11. The process fluid introduced into tubes 41 may be preheated in the convection tubes 46.

The remaining rows of convection tubes 46 may be employed for heating other fluids.

Figure 6A:
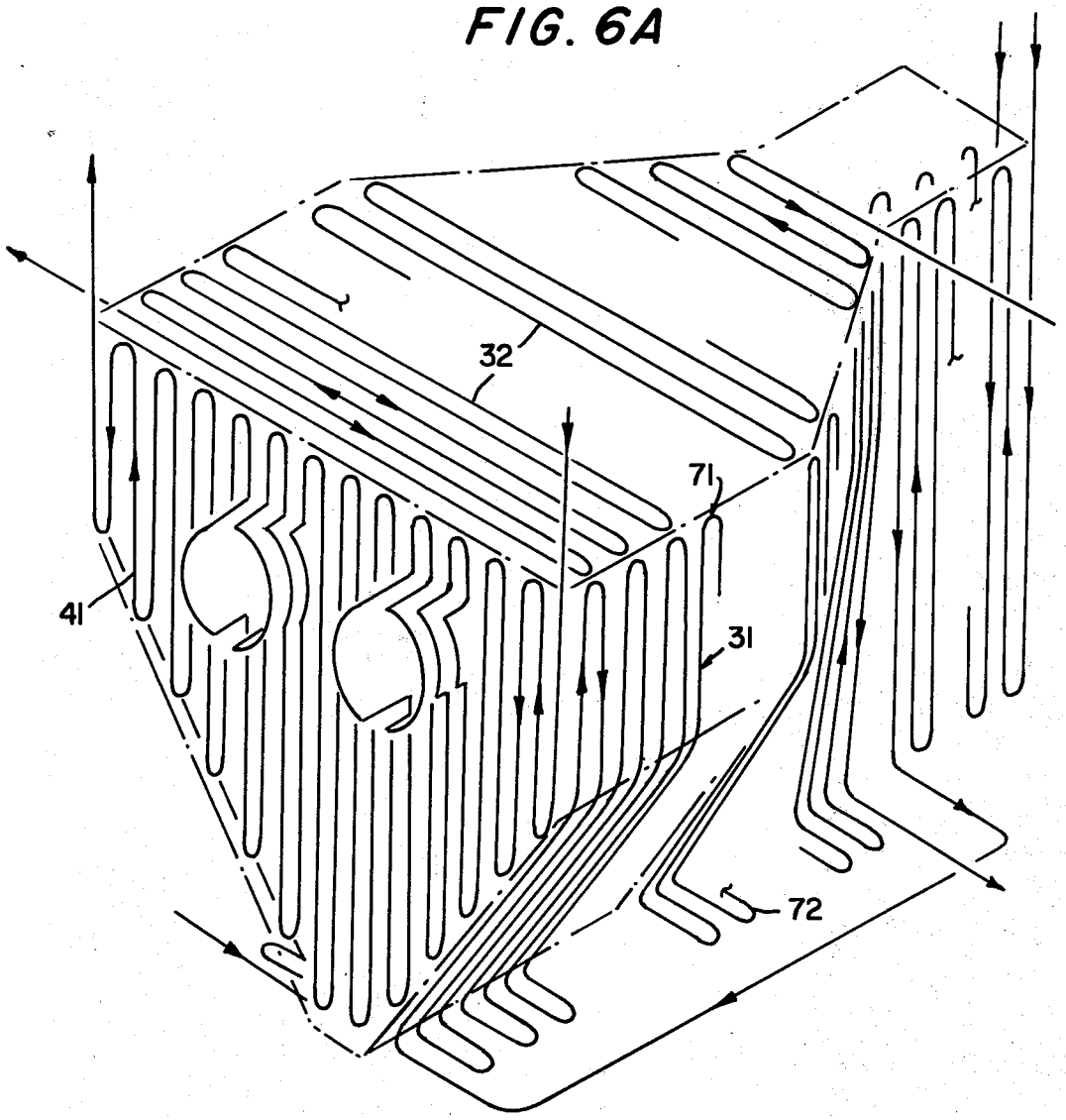
FIG. 6A is a simplified schematic isometric view of another coil arrangement for the heater.

Another coil arrangement is illustrated in FIG. 6A. In the coil arrangement illustrated in FIG. 6A, vertical tubes 31 along each of the side walls are formed into a coil through top and bottom U-bends 71 and 72 for up and down flow along the side walls. The horizontal tubes 32 are formed into a coil through U-bends for passage through the horizontal tubes back and forth across the furnace. The tubes 41 along the front wall are formed into a coil as described with reference to FIG. 6. The process fluid introduced into each of the coils of the radiant section may be pre-heated in the convection tubes 46, although only one of the coils is particularly shown as being connected to the convection tubes.

It is to be understood that two or more coils may be formed along each of the side walls and/or along the roof or front wall.

Although the embodiment has been described with respect to certain coil arrangements, it is to be understood that other coil arrangements could be employed, provided that the coil provides for at least two passes through the radiant section of the heater.

As should be apparent from the hereinabove description, the burners 38 fire hot combustion products into the radiant section 25 to heat processing fluid flowing through the processing coils by radiant heat. Ash produced in the combustion flows through the fluid cooled throat section 27 into the ash collecting hopper 24 for removal from the heater. Hot combustion gases, after heating the process fluid flowing in the process tubes, flows into the convection section 26 wherein such gases heat fluid flowing through convection tubes 46, prior to being vented through opening 15.

The heater of the present invention is particularly suited for the heating of hydrocarbon fluid; i.e., hydrocarbon liquids and/or gases, for purposes known in the art; e.g., for use as a crude heater. The heater offers the advantage that it is capable of providing such heat by the use of a high ash containing fuel; i.e., an ash content of at least 1 percent, and is particularly suitable for the use of solid fuels, such as, coal, with coals generally having ash contents in the order of from 5 to 20 percent. The ash produced in the heater is effectively removed therefrom without the necessity of shutting down the heater. The ash can be continuously or intermittently removed from the ash hopper.

The heater is designed to prevent ash build-up and flowing slag on uncooled surfaces by providing a fin tube wall construction and a sloping fluid cooled bottom for ash removal. Furthermore, such fin tube wall construction is provided while also accommodating differential expansion in the tubes. In addition, by employing vertical tubes in the convection section, there are no horizontal surfaces for ash to accumulate on. Furthermore, the heater is designed to provide for straight through gas flow to eliminate erosion caused by stratification in turn areas.

Numerous modifications and variations of the present invention are possible in light of the above teachings and, therefore, within the scope of the appended claims, the invention may be practiced otherwise than as particularly described.

We claim:

1. A process heater, comprising:

a housing having walls, a roof and an ash receiving hopper bottom, said housing defining a front radiant section and a rear convection section, said housing walls in the radiant section including a downwardly and inwardly sloping bottom portion defining an elongated throat therebetween in communication with the ash receiving hopper;

a plurality of closely spaced vertically extending tubes arranged in a single row against the walls of the radiant section and co-extensive therewith a portion of the vertically extending tubes in the radiant section including bent portions to conform to the configuration of said downwardly and inwardly sloping bottom wall portion to provide a fluid cooled bottom for ash removal;

a plurality of closely spaced horizontally extending process tubes arranged in a single row against the roof of the radiant section and coextensive therewith, said horizontal tubes extending across the radiant section between the housing walls, vertical and horizontal tubes in the radiant section being interconnected to provide at least one process fluid coil having at least two fluid passes in the radiant section;

each vertical tube against the walls of the radiant section and each horizontal tube against the roof of the radiant section including fins covering the spaces between adjacent horizontal and vertical tubes to provide a fin tube wall construction covering the walls of the radiant section including the downwardly and inwardly sloping bottom, and covering the roof of the radiant section, said fin tube wall construction preventing build-up of ash behind the tubes;

a plurality of vertical convection tubes positioned in the convection section; and at least one ash containing fuel fired burner in the front of the housing to heat process fluid.

2. The heater of claim 1 wherein the radiant section includes a front wall and opposed side walls, the top of a vertical process tube of a side wall of the radiant section being connected to the top of a vertical process tube of an opposite side wall through a horizontal tube and adjacent vertical tubes on each of said side walls being interconnected in pairs by bottom u-bends, said burners being positioned in the front wall and vertical tubes along the front wall being interconnected for up and down flow along the front walls.

3. The heater of claim 2 wherein the convection section is opposite the burners to provide for straight through gas flow.

4. The heater of claim 3 wherein the radiant section includes a converging portion for transition from the radiant section to the convection section.

5. The heater of claim 4 wherein the convection section includes a plurality of rows of vertically extending tubes, said vertically extending tubes being interconnected to provide for fluid flow countercurrent to the flow of combustion gas through the convection section.

6. The heater of claim 1 wherein adjacent vertical and horizontal tubes in the radiant section are free of connections therebetween to permit differential expansion of the tubes.

7. The heater of claim 1 wherein the radiant section includes a front wall and opposed side walls, vertical process tubes against each side wall being interconnected for up and down flow along the side wall, horizontal tubes being interconnected for back and forth flow across the radiant section and vertical process tubes along the front wall being interconnected for up and down flow along the front wall, said burners being positioned in the front wall.

8. The heater of claim 7 wherein the convection section is opposite the burners to provide for straight through gas flow.

9. The heater of claim 8 wherein the convection section includes a plurality of rows of vertically extending tubes, said vertically extending tubes being interconnected to provide for fluid flow countercurrent to the flow of combustion gas through the convection section.

10. The heater of claim 1 wherein the burners are coal burners.

11. The heater of claim 1 wherein the radiant section includes only said tubes along said walls and roof.

12. The heater of claim 1 wherein the convection section includes a plurality of rows of vertically extending tubes, said vertically extending tubes being interconnected to provide for fluid flow co-current to the flow of combustion gas through the convection section.

* * * * *